US008465309B2

(12) United States Patent
Tsuji et al.

(10) Patent No.: US 8,465,309 B2
(45) Date of Patent: Jun. 18, 2013

(54) DETECTION SWITCH STRUCTURE AND CONNECTOR HAVING THE SAME

(75) Inventors: Junya Tsuji, Kanagawa (JP); Tatsuki Watanabe, Kanagawa (JP); Martijn Riemeijer, Hertogenbosch (NL)

(73) Assignees: Tyco Electronics Japan G.K., Kanagawa-Ken (JP); Tyco Electronics Netherland B.V., Ag's-Hertogenbosch (NL)

( * ) Notice: Subject to any disclaimer, the term of this patent is extended or adjusted under 35 U.S.C. 154(b) by 0 days.

(21) Appl. No.: 13/325,267

(22) Filed: Dec. 14, 2011

(65) Prior Publication Data

US 2012/0149224 A1 Jun. 14, 2012

(30) Foreign Application Priority Data

Dec. 14, 2010 (JP) ..... 2010-278433

(51) Int. Cl.
*H01R 29/00* (2006.01)

(52) U.S. Cl.
USPC ..... 439/188

(58) Field of Classification Search
USPC ..... 439/326–328, 188
See application file for complete search history.

(56) References Cited

U.S. PATENT DOCUMENTS

| | | | | |
|---|---|---|---|---|
| 6,015,311 | A * | 1/2000 | Benjamin et al. | 439/267 |
| 6,059,592 | A * | 5/2000 | Inadama | 439/188 |
| 7,416,428 | B1 * | 8/2008 | Hung et al. | 439/188 |
| 2005/0059281 | A1 * | 3/2005 | Bricaud et al. | 439/188 |

FOREIGN PATENT DOCUMENTS

| | | | |
|---|---|---|---|
| JP | 2002-342629A | A | 11/2002 |
| JP | 2006-66281 | A | 3/2006 |
| JP | 2008-299854 | A | 12/2008 |
| JP | 2008299854 | A * | 12/2008 |

* cited by examiner

*Primary Examiner* — Neil Abrams
*Assistant Examiner* — Travis Chambers
(74) *Attorney, Agent, or Firm* — Barley Snyder

(57) ABSTRACT

A detection switch for detecting when a card is inserted in to a connector. The detection switch includes a housing, a shell, a card receiving passageway, and a detection switch. The shell is disposed on and covers the housing. The card receiving passageway is arranged between the housing and the shell. The detection switch detects when the card is inserted into the card receiving passageway and disposed along a side of the card connector. The detection switch includes a fixed contact secured to the housing, and a movable contact extending from the shell and configured to (1) contact the fixed contact when the card is not inserted in the card receiving passageway and (2) release from contact with the fixed contact when the card is inserted into the card receiving passageway.

7 Claims, 15 Drawing Sheets

DETECTION SWITCH STRUCTURE AND CONNECTOR HAVING THE SAME

CROSS-REFERENCE TO RELATED APPLICATION

This application claims the benefit under 35 U.S.C. §119 (a)-(d) of Japanese Patent Application No. 2010-278433, filed on Dec. 14, 2010.

FIELD OF THE INVENTION

The invention relates to a detection switch and, in particular, to a detection switch having a metal fixed contact and a metal movable contact that release from contact when a card is inserted in to a connector.

BACKGROUND

Conventionally, a card connector for receiving a card such as a memory card, a SIM (Subscriber Identity Module) card, or the like generally has a detection switch for detecting insertion of such a card.

For instance, JP 2002-324629 A discloses a card socket having a pair of contact members included in a detection switch for detecting the insertion of a card. In this card socket, when the card is inserted into the card socket, an edge corner portion of the card abuts a slant portion of one of the contact members. One of the contact members is displaced, a first contact of the contact member comes into wiping contact with a second contact of the other contact portion, and then the detection switch turns on. Accordingly, the insertion of the card can be detected.

Additionally, JP 2006-66281 A discloses a coaxial connector with a switch having a switch mechanism disposed in an insulating housing. The switch mechanism is composed of a connection plate and a changeover spring. The connection plate includes a secured portion secured to the housing, a flat plate-shaped contact portion extending from the secured portion, and a connecting portion connected to a circuit board. In addition, the changeover spring is provided with a secured portion secured to the housing, an elastic arm portion extending from the secured portion, a contact piece extending from the elastic arm portion to be in contact with the contact portion, and a connecting portion connected to the circuit board extending from the secured portion.

The contact piece of the changeover spring is in contact with the flat plate-shaped contact portion of the connection plate, when a mating pin is not inserted into the housing. Furthermore, as to the contact piece of the changeover spring, when the mating pin is inserted into the housing, the mating pin causes the contact piece to move apart from the flat plate-shaped contact portion of the connection plate, so that contact is released.

Moreover, JP 2008-299854 A discloses a mounting socket having a detection switch, for a memory card and a SIM card. The detection switch is integrally formed with an upper metal housing and a lower metal plate sandwiching the socket body from top and bottom. The detection switch is provided with an elastic bending piece extending from the upper metal housing, and a vertical contact projection extending from the lower metal plate to be in contact with the elastic bending piece. The elastic bending piece is in contact with the vertical contact projection, when the memory card or the SIM card is not inserted into the socket. When the card is inserted into the socket, the card displaces the elastic bending piece upward to move apart from the vertical contact projection, so that the contact state is released. Accordingly, the insertion of the card is detected.

As conventionally employed, however, the card socket described in JP 2002-324629 A, the coaxial connector with a switch described in JP 2006-66281 A, and the mounting socket for the memory card and the SIM card described in JP 2008-299854 A have the following problems.

That is, in a case of the card socket described in JP 2002-324629 A, since the first contact of one of the contact members is in close contact with the second contact of the other thereof at the time of detecting the insertion of the card, greater contact displacement is necessary when switching. This poses a problem in that downsizing of the card socket is difficult.

Besides, in a case of the coaxial connector with a switch described in JP 2006-66281 A, the contact between the contact piece of the changeover spring and the flat plate-shaped contact portion of the connection plate forms a line-surface contact between a line in the plate-thickness direction of the contact piece and a surface of the flat plate-shaped contact portion. For this reason, there is a problem that the Hertz stress is low at the time of contact.

If the Hertz stress is low, then the contact force between the contact piece and the flat plate-shaped contact portion is insufficient. Therefore, the contact force needs to be increased in order to improve the contact reliability.

In order to improve the contact reliability, the contact piece needs to be made larger by increasing the thickness of the contact piece or the like. This poses a problem in that the connector itself becomes bigger in size. Furthermore, when the contact piece is supported by the housing, with the contact force being increased by the contact piece, the housing relaxes the stress at the time of the reflow soldering connection. This causes a problem that the housing changes its shape significantly. Hence, the increased Hertz stress is desirably made higher to ensure the contact force between the contact piece and the contact portion, even in the decreased load placed by the contact piece.

Moreover, in a case of the mounting socket for the memory card and the SIM card described in JP 2008-299854 A, the contact between the elastic bending piece and the vertical contact projection forms a surface-surface contact or a surface-line contact between the surface of the elastic bending piece and the surface of the vertical contact projection. For this reason, there is a problem that the Hertz stress is low at the time of contact.

SUMMARY

Accordingly, the present invention has been made in view of the above problems, and has an object, inter alia, to provide a detection switch for a connector, in which downsizing can be achieved without the need of wiping at the time of contact, a larger Hertz stress is obtainable, and the contact reliability is high.

The detection switch is used to detect when a card is inserted in to a connector. The detection switch includes a housing, a shell, a card receiving passageway, and a detection switch. The shell is disposed on and covers the housing. The card receiving passageway is arranged between the housing and the shell. The detection switch detects when the card is inserted into the card receiving passageway and disposed along a side of the card connector. The detection switch includes a fixed contact secured to the housing, and a movable contact extending from the shell and configured to (1) contact the fixed contact when the card is not inserted in the card receiving passageway and (2) release from contact with the fixed contact when the card is inserted into the card receiving passageway.

BRIEF DESCRIPTION OF THE DRAWINGS

The above and other features of the present invention will become more apparent by describing in detail embodiments thereof with reference to the accompanying drawings, in which.

DETAILED DESCRIPTION OF THE EMBODIMENT(S)

Figure 1:
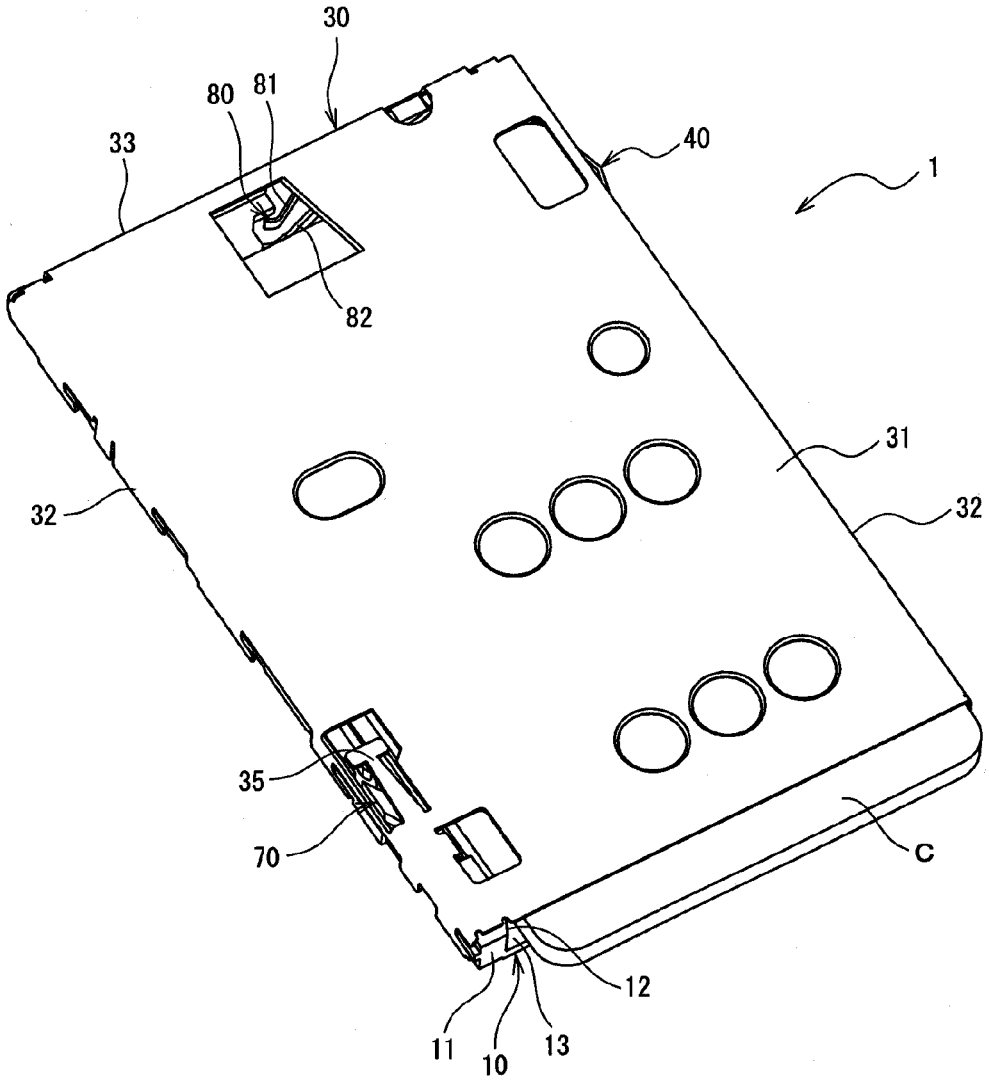
FIG. 1 is a perspective view of a connector according to the invention and showing a card is inserted thereinto.

Hereinafter, embodiments of the present invention will be described with reference to the drawings.

A connector 1 shown in FIG. 1 to FIG. 10 is mounted on a circuit board (not shown) and receives a card C (an object to be detected) such as a memory card, a SIM card, or the like. The connector 1 receives the card C, thereby achieving an electrical connection between the card C and the circuit board.

The connector 1 includes an insulating housing 10, multiple metal contacts 20, a metal shell 30, a detection switch 40, a cam mechanism 70, and a card removal detection switch 80.

Figure 2:
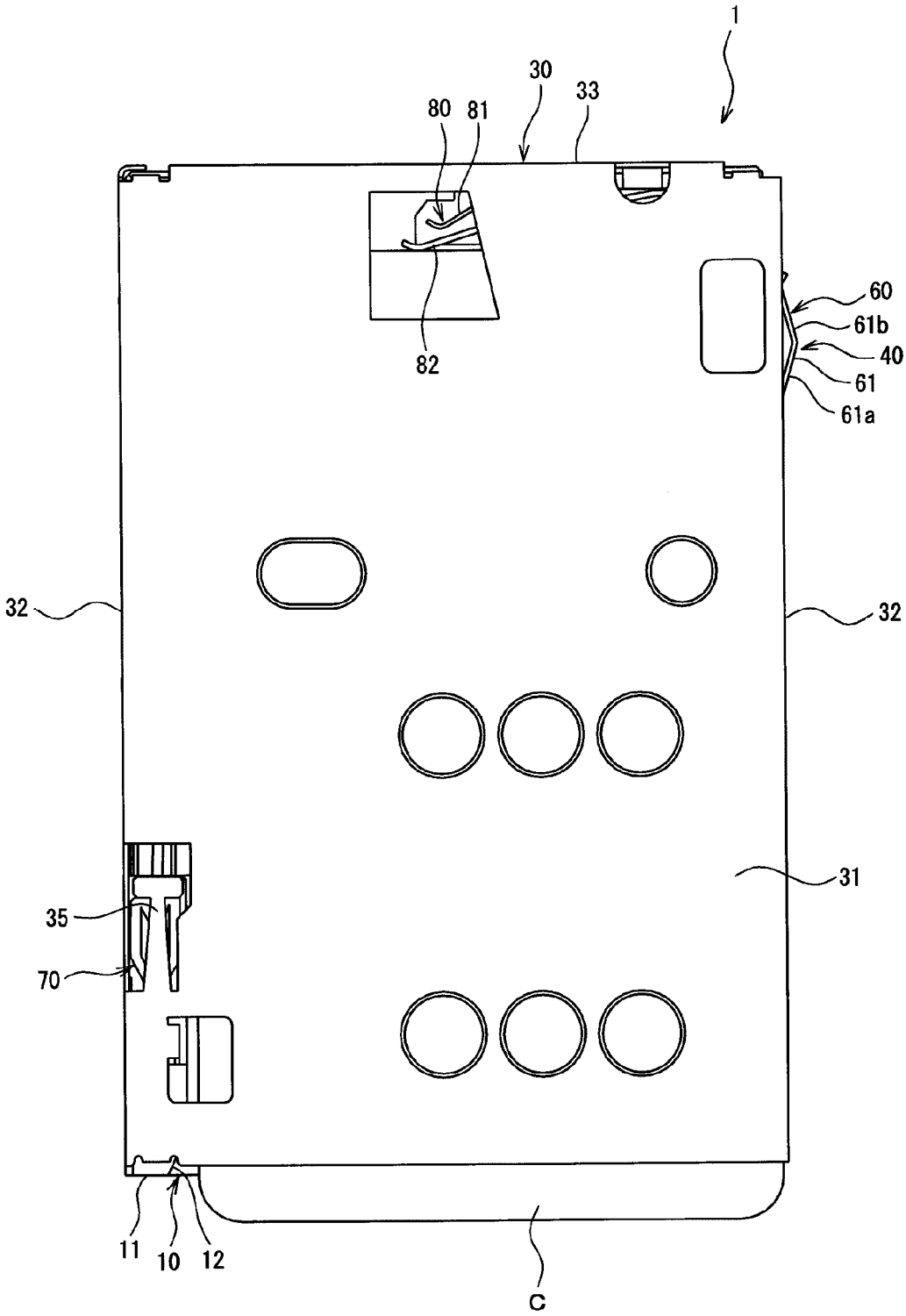
FIG. 2 is a plan view of the connector shown in FIG. 1.
Figure 3:
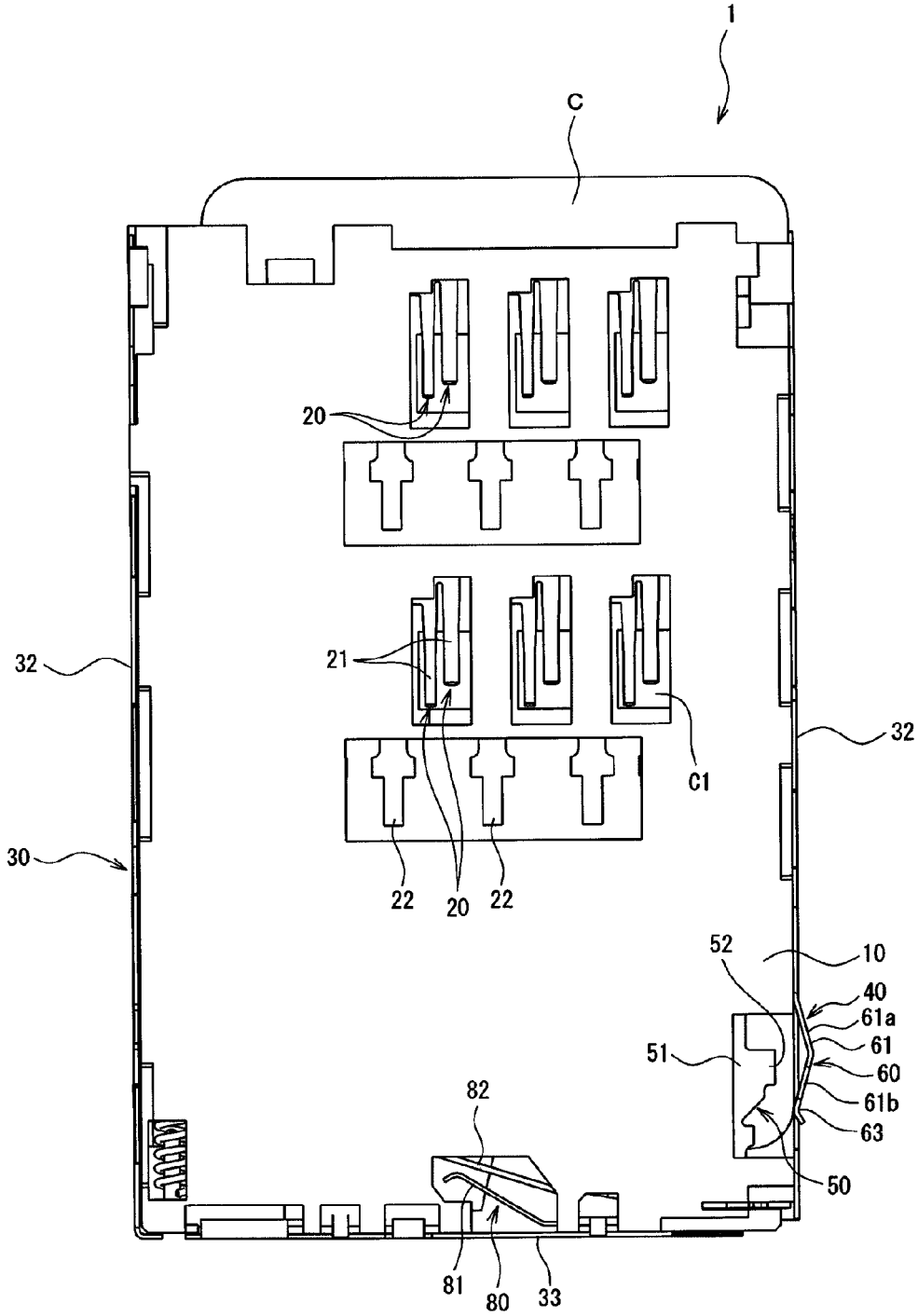
FIG. 3 is a bottom view of the connector shown in FIG. 1.
Figure 6:
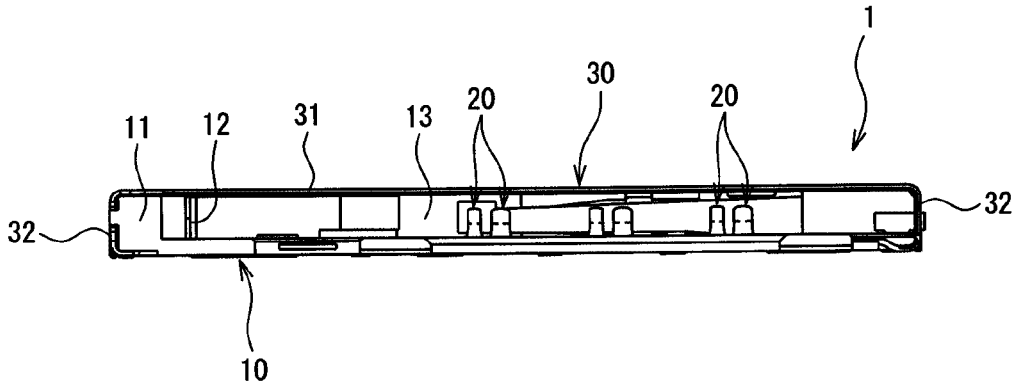
FIG. 6 is a front view of the connector shown in FIG. 1.
Figure 7:
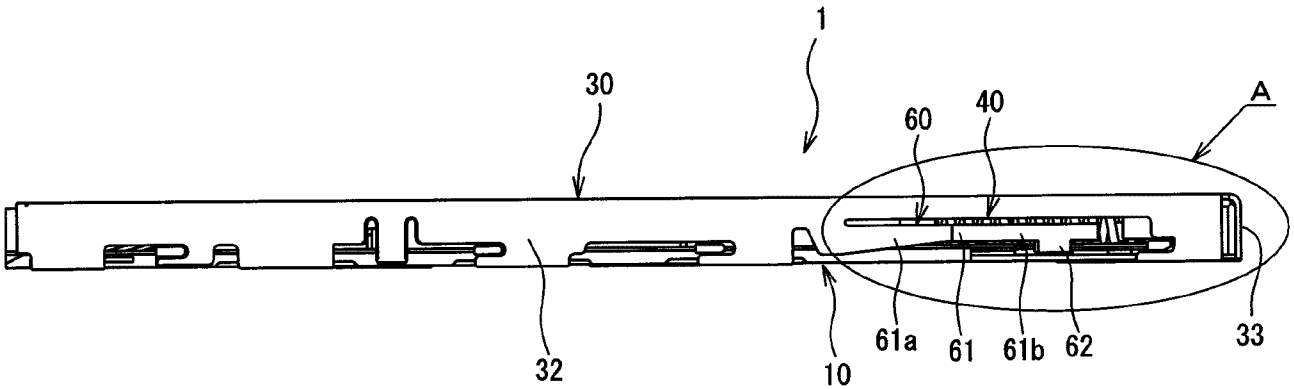
FIG. 7 is a right side view of the connector shown in FIG. 1.
Figure 8:
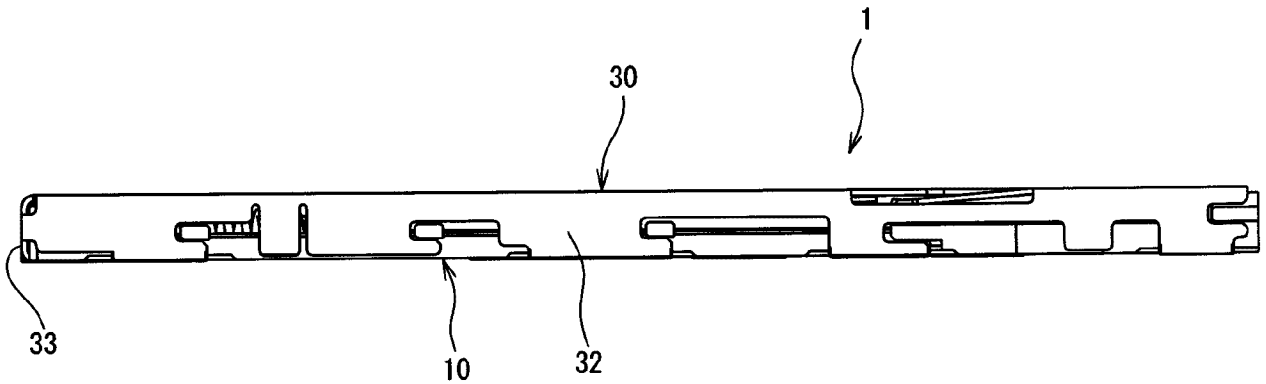
FIG. 8 is a left side view of the connector shown in FIG. 1.
Figure 9:
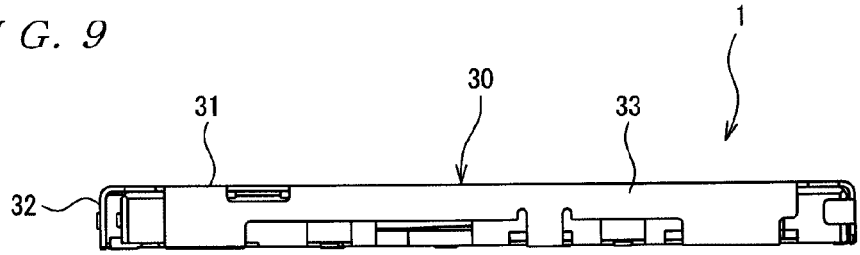
FIG. 9 is a rear view of the connector shown in FIG. 1.
Figure 10:
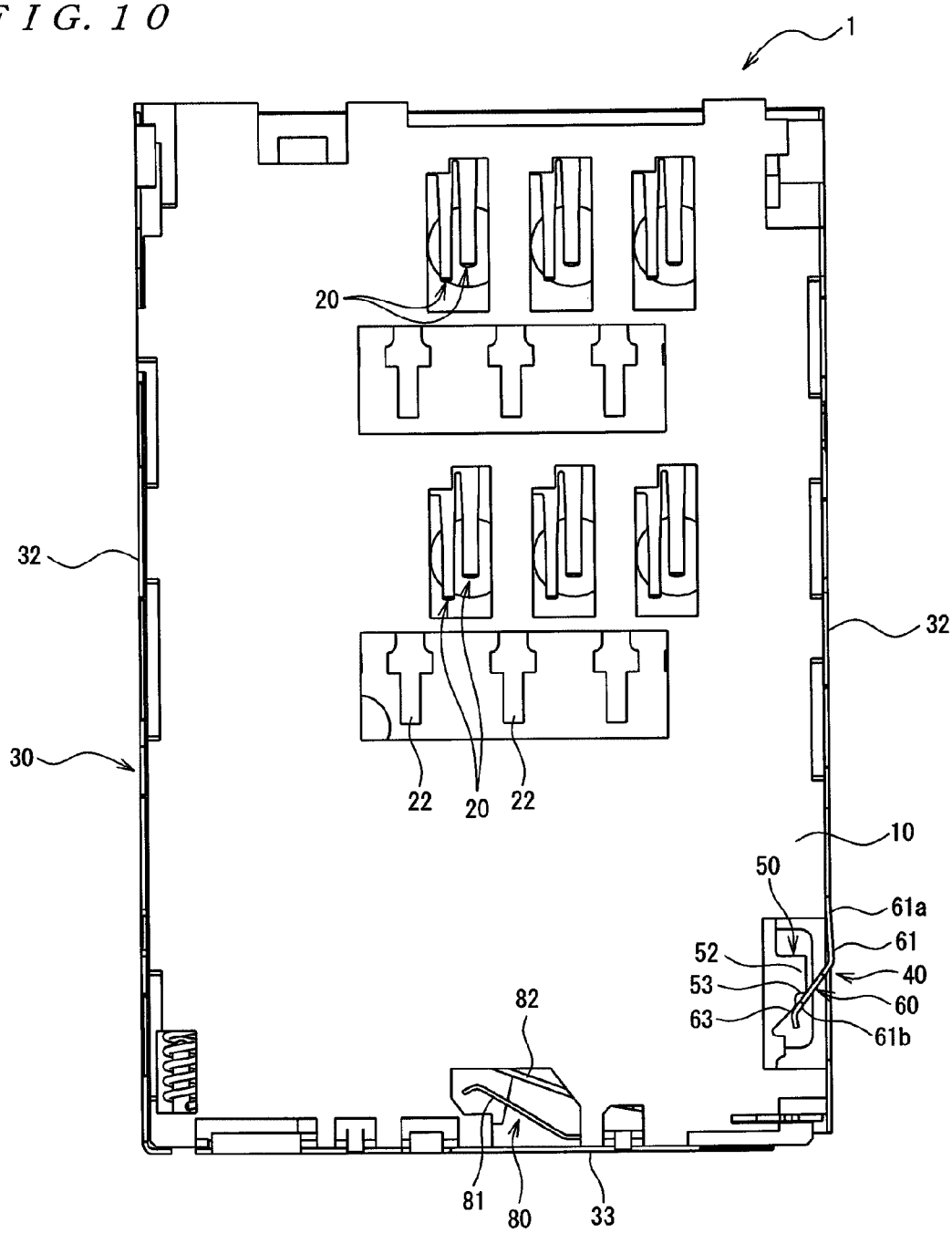
FIG. 10 is a bottom view of the connector shown in FIG. 1.

Referring to FIG. 1 to FIG. 3, the housing 10 is configured to receive the card C from the front side (lower side in FIG. 2). The housing 10 is formed in a substantially rectangular shape extending in the width direction (left-right direction in FIG. 2 and FIG. 5) and in the length direction by molding an insulating resin. The housing 10 includes a left-side wall 11 having therein an insertion guiding surface 12 for the card C, as shown in FIG. 1 and FIG. 6. A card receiving passageway 13 is arranged between the housing 10 and the shell 30 (a planar portion 31) covering the housing 10. When the card C is inserted into the card receiving passageway 13, the insertion guiding surface 12 of the left-side wall 11 guides the left-side surface of the card C and an inner side of the a side surface 32 of the shell 30 guides the right-side surface of the card C.

The multiple contacts 20 are disposed to form two rows in the width direction of the housing 10 at the front side of the housing 10, as shown in FIG. 3, FIG. 4, FIG. 5, and FIG. 10. Each contact 20 includes (1) a contact portion 21 for contact with a conductive pad C1 (see FIG. 3) disposed on the rear surface of the card C, and (2) a board connector 22 for connecting to the circuit board. Each contact 20 is formed by stamping and forming a conductive metal plate. When the card C is inserted into the card receiving passageway 13, the contact portion 21 comes into contact with the conductive pad C1 provided on the rear surface of the card C and becomes electrically conductive.

Additionally, the shell 30 is mounted on the housing 10 to cover at least a part of the housing 10. The shell 30 includes a planar surface portion 31 covering the top surface of the housing 10, a pair of side surfaces 32 covering both side surfaces in the width direction of the housing 10, and a rear surface portion 33 covering the rear surface of the housing 10. The planar surface portion 31 extends in the width and length directions of the housing 10. Each of the side surfaces 32 extends downwardly from each side surface in the width direction of the planar surface portion 31. In addition, the rear surface portion 33 extends downwardly from the rear surface in the length direction of the planar surface portion 31. The shell 30 is formed by stamping and forming a metal plate. Specifically, a cam rod pushing piece 35 having a cantilever shape for pushing down the cam rod (not shown) of a cam mechanism 70, to be described later, at the front left end of the planar surface portion 31.

Figure 4:
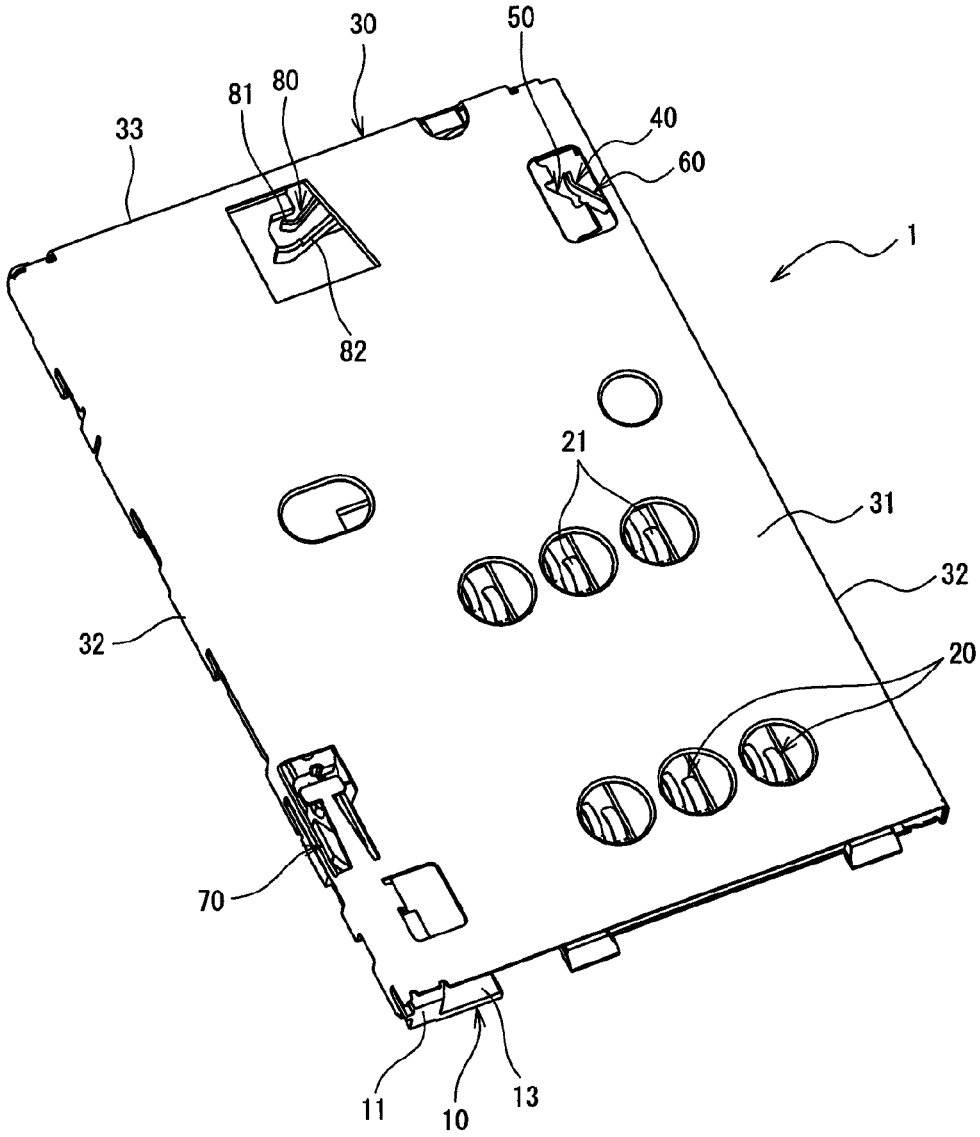
FIG. 4 is a perspective view of the connector shown in FIG. 1.
Figure 5:
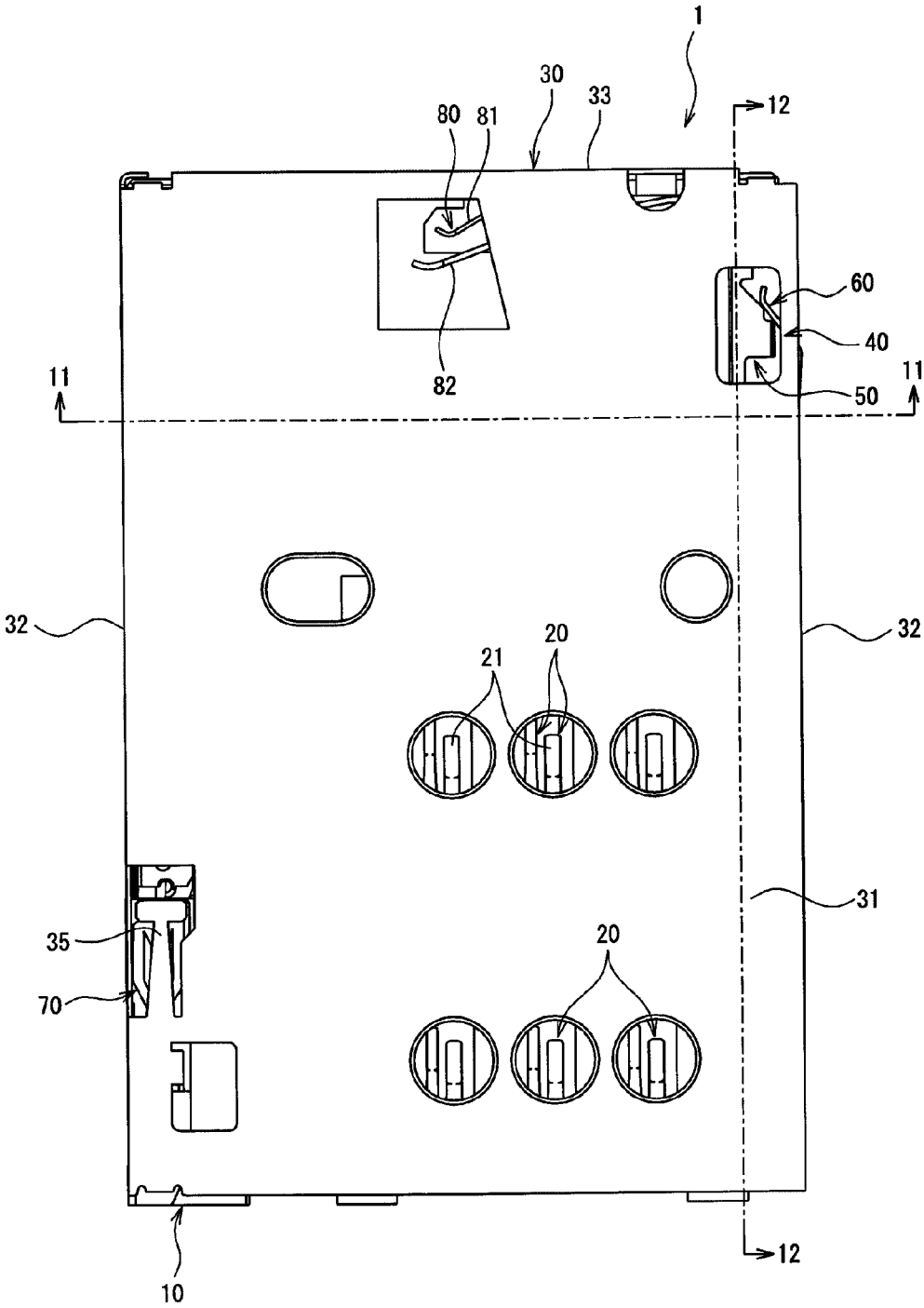
FIG. 5 is a plan view of the connector shown in FIG. 1.
Figure 13A:
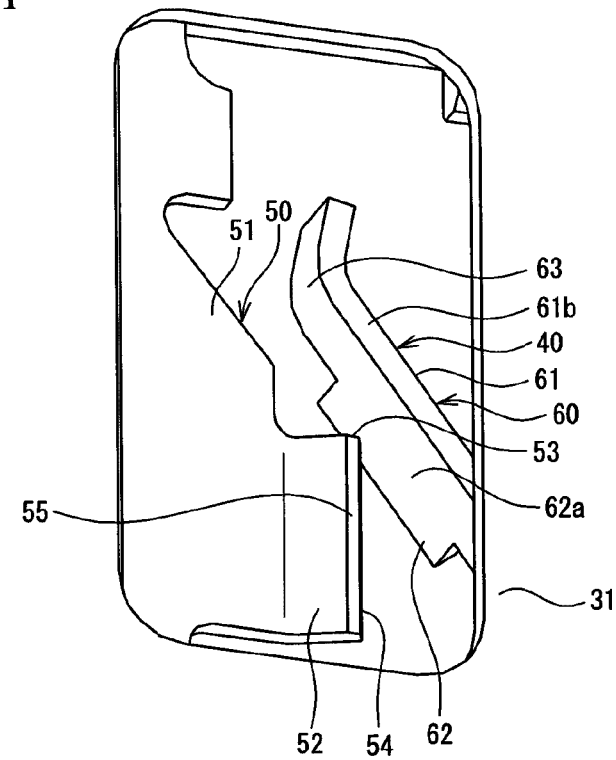
FIG. 13A is a perspective view of a detection switch of the connector shown in FIG. 1.
Figure 13B:
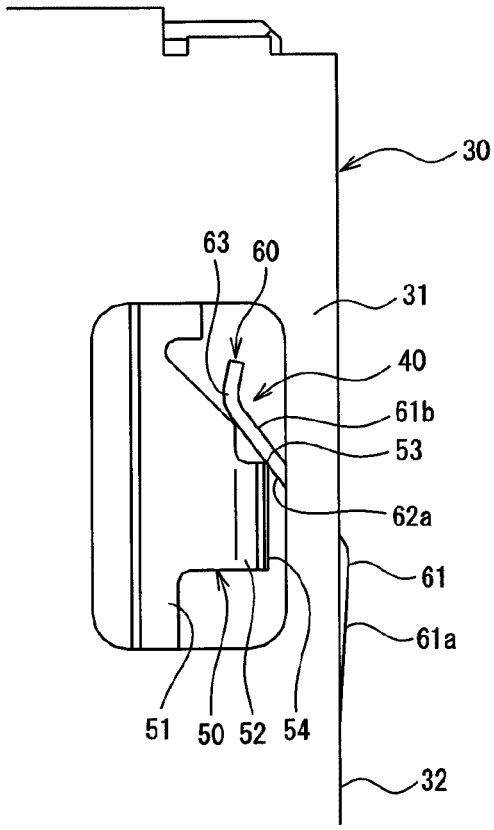
FIG. 13B is a plan view of a detection switch of the connector shown in FIG. 1.
Figure 14:
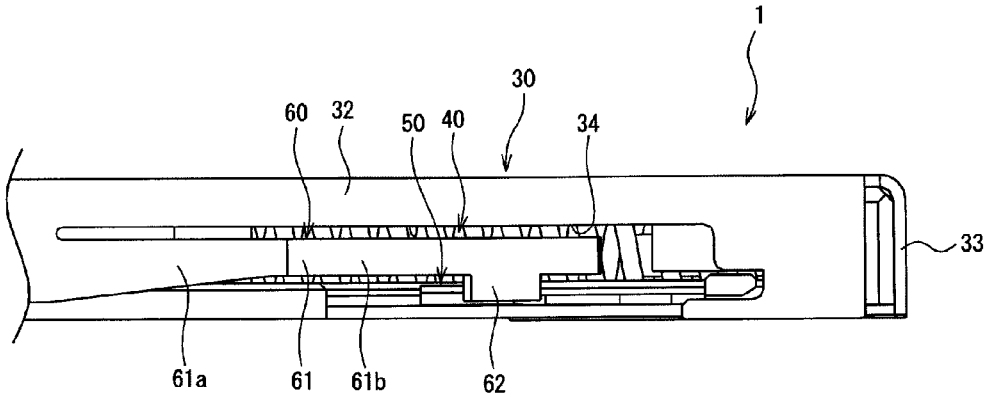
FIG. 14 is an enlarged view of portion A in FIG. 7.
Figure 17A:
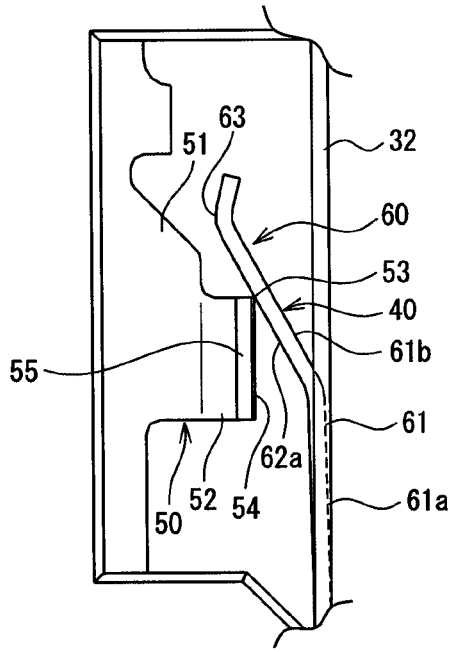
FIG. 17A is a plan view of a case of the connector according to the invention, where the card is not inserted thereinto.
Figure 17B:
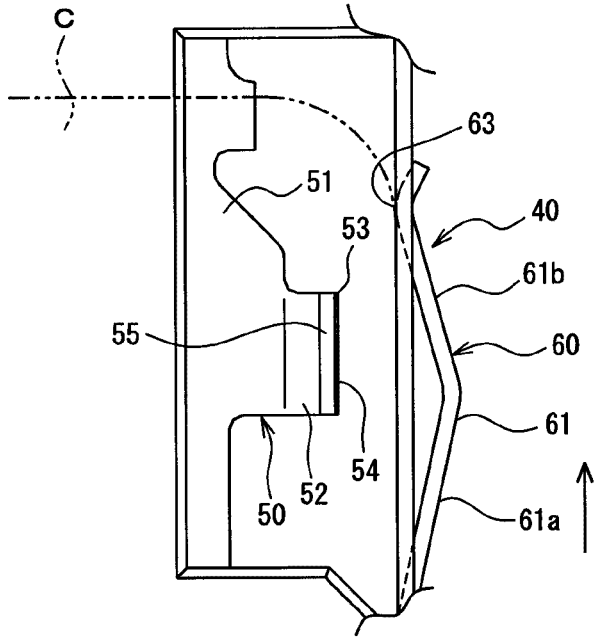
FIG. 17B is a plan view of a case of the connector according to the invention, where the card is inserted thereinto.

Furthermore, the detection switch 40 is provided for detecting whether or not the card C is inserted into the card receiving passageway 13 of the housing 10, and is disposed at the rear right side of the card connector 1, as shown in FIG. 1 to FIG. 5. The detection switch 40 includes a metal fixed contact 50, and a metal movable contact 60, which are in contact with each other, when the card C is not inserted into the card receiving passageway 13, as shown in FIG. 4, FIG. 13A, and FIG. 13B. When the card C is inserted into the card receiving passageway 13, the movable contact 60 is driven to release the contact state between the movable contact 60 and the fixed contact 50, as shown in FIG. 17A and FIG. 17B. In this manner, it is detected the insertion of the card C is completed. In this situation, the contact between the fixed contact 50 and the movable contact 60 is achieved, as specifically shown in FIG. 13A, by bringing a corner portion 53 of the fixed contact 50 and one surface 62*a* of the movable contact 60 into contact with each other. Hereinafter, the detailed structures of the fixed contact 50 and the movable contact 60 will be described.

Figure 11:
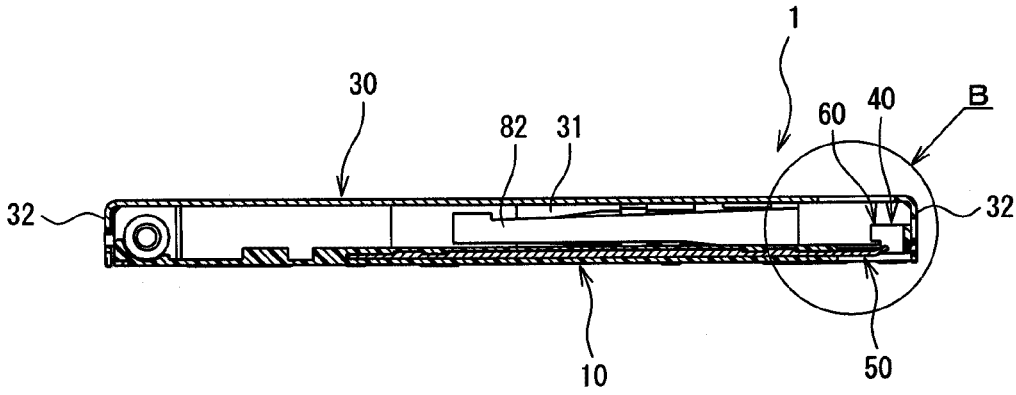
FIG. 11 is a cross-sectional view of the connector shown in FIG. 5 taken along line 11-11.
Figure 12:
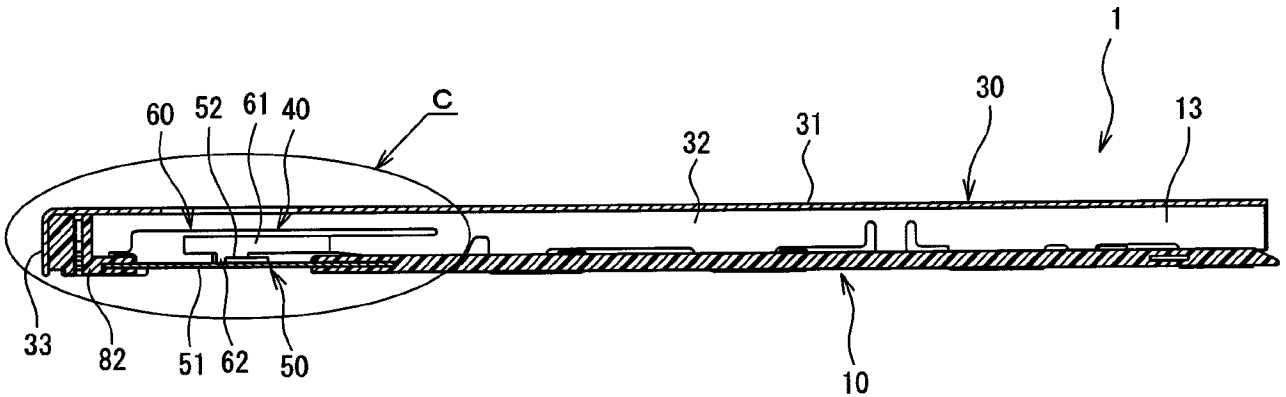
FIG. 12 is a cross-sectional view of the connector shown in FIG. 5 taken along line 12-12.

The fixed contact 50 is formed by stamping and forming a metal plate, and is secured to the housing 10 by insert molding, as shown in FIG. 11 and FIG. 12. The fixed contact 50 includes a secured portion 51 to be secured to the housing 10, as shown in FIG. 11 and FIG. 12. The secured portion 51 is formed to have a flat-plate shape extending in the width and length directions of the housing 10. In addition, the fixed contact 50 includes a fixed contact piece 52 extending outward and obliquely upward in the width direction from the side portion of the width direction, as specifically shown in FIG. 13A and FIG. 13B. Furthermore, the leading end of the fixed contact piece 52 includes a trimmed surface 54 made by stamping the metal plate, and an inclined surface 55 is formed from the trimmed surface 54 to the upper surface of the fixed contact piece 52. Referring now to FIG. 13A, the rear side lower corner out of four corners formed in the trimmed surface 54 corresponds to the corner portion 53 to be in contact with one surface 62*a* of the movable contact piece 61 in the movable contact 60.

Moreover, the movable contact 60 has a movable contact piece 61 having a cantilever shape extending rearwardly from the side surface 32 of the shell 30, as shown in FIG. 7, FIG. 13A, FIG. 13B, FIG. 14, and FIG. 15. The movable contact piece 61 includes a extension 61*a* extending rearwardly in a free state from the side surface 32, and a contact arm section 61*b* extending obliquely inwardly in the width direction from the rear end of the extension 61*a*.

A contact projection portion 62 having one surface 62*a* to be in contact with the corner portion 53 of the fixed contact 50 is disposed at the lower portion of the contact arm section 61*b*. One surface 62*a* of the contact projection portion 62 is present at the inside of the contact projection portion 62. Referring to FIG. 13B, a curved portion 63, which is brought into contact with the linear side surface of the card C, when the insertion of the card C into the card receiving passageway 13 is completed, is arranged at the leading end of the contact arm section 61*b* of the movable contact piece 61.

Figure 15:
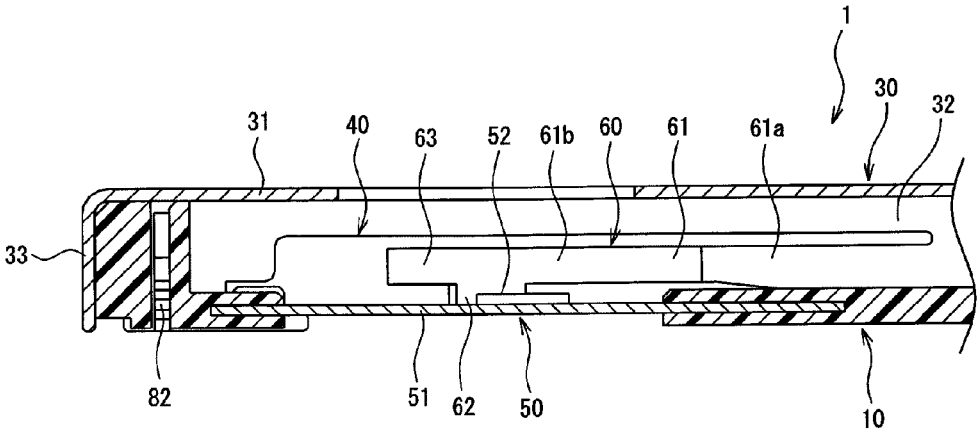
FIG. 15 is an enlarged view of portion C in FIG. 12.
Figure 16:
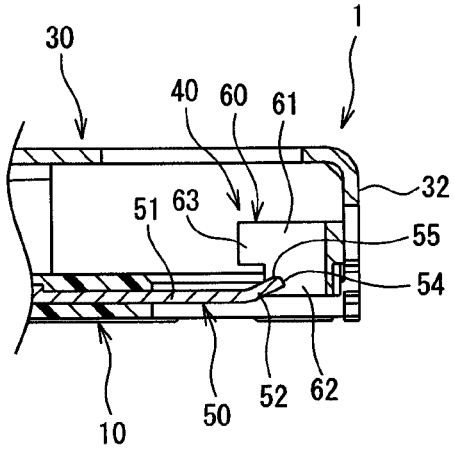
FIG. 16 is an enlarged view of portion B in FIG. 11.

In addition, the cam mechanism 70 makes it possible to eject the card with a so-called push-push action, and has a known structure. Therefore, the description thereof will be omitted. Furthermore, the card removal detection switch 80 detects a state where the card C inserted into the card receiving passageway 13 is removed. The card removal detection switch 80 is disposed at the rear end portion of the card connector 1, as shown in FIG. 1 to FIG. 5. The card removal detection switch 80 includes a first switch piece 81 extending from the rear surface portion 33 of the shell 30; and a second switch piece 82 brought into contact with the first switch piece 81 when the card C is removed. Referring to FIG. 15, the second switch piece 82 is secured to the housing 10. When the insertion of the card C into the card receiving passageway 13 is completed, the second switch piece 82 is spaced apart from the first switch piece 81, as shown in FIG. 2. When the card C is moved rearwardly in order to remove the card C, the second switch piece 82 is brought into contact with the first switch piece 81. In this manner, the removal of the card is detected.

Next, referring to FIG. 17A and FIG. 17B, the action of the detection switch 40 will be described in detail.

Firstly, as shown in FIG. 17A, when the card C is not inserted into the card receiving passageway 13, one surface 62*a* of the contact projection portion 62 included in the movable contact 60 is in contact with the corner portion 53 of the fixed contact 50. The contact force between one surface 62*a* and the corner portion 53 is ensured by an elastic force of the movable contact piece 61. In this state, the detection switch 40 is switched on, and it means that insertion of the card C has not been carried out.

In this situation, the contact between the fixed contact 50 and the movable contact 60 is achieved by bringing the corner portion 53 of the fixed contact 50 and one surface 62*a* of the movable contact 60 into contact with each other. Accordingly, the wiping contact is not needed when the fixed contact 50 and the movable contact 60 are in contact with each other. It is therefore possible to provide a detection switch 40, in which downsizing thereof can be achieved, a large Hertz stress is obtainable with a point-surface contact being achieved, and contact reliability is set high.

In addition, the connector 1 has the detection switch 40, and the fixed contact 50 is secured to the housing 10 for receiving the card C, whereas the movable contact 60 extends from the metal shell 30 covering at least a part of the housing 10. It is therefore possible to provide the connector 1 having the detection switch 40 with high contact reliability.

Furthermore, the fixed contact 50 is secured to the housing 10, and has the flat plate-shaped secured portion 51 extending in the width and the length directions of the housing 10 and the fixed contact piece 52 extending outward and obliquely upward in the width direction from the side portion of the width direction. On the other hand, the movable contact 60 has the cantilever-shaped movable contact piece 61 extending obliquely inwardly in the width direction from the side surface 32 of the shell 30. Then, the contact between the fixed contact 50 and the movable contact 60 is achieved by the corner portion 53 of the fixed contact piece 52 and one surface 62*a* of the movable contact piece 61 coming into contact with each other. Accordingly, it is possible to obtain the fixed contact 50 and the movable contact 60 for achieving the contact between the corner portion 53 and one surface 62*a* with a simple structure. Moreover, since the movable contact 60 has the cantilever-shaped movable contact piece 61, it is possible to ensure a reliable contact force when the corner portion 53 of the fixed contact 50 and one surface 62*a* of the movable contact 60 are in contact with each other.

Additionally, the fixed contact 50 is formed by stamping and forming a metal plate, so the corner portion 53 of the fixed contact piece 52 is arranged at a corner of the trimmed surface 54 formed by stamping the metal plate. This allows the corner portion 53 of the fixed contact piece 52 to be formed with ease when the fixed contact 50 is formed.

Then, from the contact state between the fixed contact 50 and the movable contact 60, the card C is inserted into the card receiving passageway 13, as shown in FIG. 17B. After that, the curved surface formed at a front-end corner rim of the card C comes into contact with an inner surface of the contact arm section 61*b* included in the movable contact piece 61 of the movable contact 60. This is because the contact arm section 61*b* extends obliquely, inwardly in the width direction from the rear end of the extension 61*a* of the movable contact piece 61, and protrudes into the card receiving passageway 13.

Subsequently, as the insertion of the card C proceeds, the contact arm section 61*b* is displaced outward in the width direction along the curved surface of the card C. This causes one surface 62*a* of the contact projection portion 62 to move apart from the corner portion 53 of the fixed contact 50, and releases the contact state between the movable contact 60 and the fixed contact piece 52. In this state, the detection switch 40 is switched off, and it means that the insertion of the card C is detected.

As insertion of the card C further proceeds and insertion of the card C is completed, the curved portion 63 of the movable contact 60 comes into contact with the linear side surface of the card C. Contact force of the curved portion 63 with the side surface of the card C is ensured by a spring force of the movable contact piece 61.

Specifically, when the card C is inserted into the card receiving passageway 13, conductive pads C1 arranged on the rear surface of the card C are in contact with the contact portion 21 of the contacts 20, respectively, so that the card C and the circuit board are electrically connected through the respective contacts 20.

In contrast, when the card C is removed from the card receiving passageway 13, and the card C is moved toward the read side, the action of a spring, not shown, biases the card C to the front side, thereby enabling the card C to be removed from the card receiving passageway 13. In the removing process of the card C, the movable contact 60 operates in a reverse manner of the insertion process of the card C. When the removal of the card C is completed, one surface 62*a* of the contact projection portion 62 included in the movable contact 60 is brought into contact with the corner portion 53 of the fixed contact 50 again.

The embodiments of the present invention have been described heretofore. However, it will be appreciated that the present invention is susceptible of modification, variation and change without limiting to this.

An example is that the detection switch 40 is applicable not only to a case where insertion of the card C is detected, but also to a situation where the insertion of a mating connector to be mated with the connector is detected.

Additionally, the detection switch 40 may not be provided with the connector having the housing and the shell.

The detection switch 40 may take any structure design as long as the contact, between the movable contact and the fixed contact, releases after the movable contact is moved when the object to be detected engages the movable contact.

Furthermore, the contact between the fixed contact and the movable contact may be achieved by one surface of the fixed contact coming into touch with the corner portion of the movable contact.

What is claimed is:

1. A connector for receiving a card, the connector comprising:

a housing;

a shell disposed on and covering the housing;

a card receiving passageway arranged between the housing and the shell; and a detection switch for detecting when the card is inserted into the card receiving passageway and disposed along a side of the connector, the detection switch having:

a fixed contact secured to the housing and having a point corner portion; and a movable contact extending from the shell and configured to (1) contact the point corner portion of the fixed contact when the card is not inserted in the card receiving passageway and (2) release from contact with the point corner portion of the fixed contact when the card is inserted into the card receiving passageway.

2. The connector according to claim 1, wherein the housing is substantially rectangular.

3. The connector according to claim 1, wherein the fixed contact includes a flat plate secured portion secured to the housing and extending in width and length directions of the housing.

4. The connector according to claim 3, wherein the fixed contact further includes a fixed contact piece extending outward and obliquely upward from a side portion of the flat plate secured portion.

5. The connector according to claim 4, wherein the shell includes (1) a planar portion covering a top surface of the housing and (2) a side surface portion extending downward from a side surface of the planar portion and covering a side surface of the housing.

6. The connector according to claim 5, wherein the movable contact includes a cantilever movable contact piece extending obliquely inward from the side surface portion of the shell.

7. A detection switch for detecting insertion of a card into a card receiving passageway of a connector, the detection switch having:

a fixed contact secured to a housing of the connector and having a point corner portion; and a movable contact extending from a shell of the connector and configured to (1) contact the point corner portion of the fixed contact when the card is not inserted in the card receiving passageway and (2) release from contact with the point corner portion of the fixed contact when the card is inserted into the card receiving passageway.

* * * * *